US011807484B2

(12) United States Patent
Reger et al.

(10) Patent No.: US 11,807,484 B2
(45) Date of Patent: Nov. 7, 2023

(54) COVER MEMBER FOR A STORING MEANS FOR STACKED FLAT ELEMENTS

(71) Applicant: Gerresheimer Regensburg GmbH, Regensburg (DE)

(72) Inventors: Florian Reger, Pfreimd (DE); Vitus Schönberger, Fensterbach (DE)

(73) Assignee: Gerresheimer Regensburg GmbH, Regensburg (DE)

( * ) Notice: Subject to any disclaimer, the term of this patent is extended or adjusted under 35 U.S.C. 154(b) by 250 days.

(21) Appl. No.: 17/203,331

(22) Filed: Mar. 16, 2021

(65) Prior Publication Data

US 2021/0292117 A1 Sep. 23, 2021

(30) Foreign Application Priority Data

Mar. 17, 2020 (EP) ..... 20163477

(51) Int. Cl.
*B65H 3/08* (2006.01)

(52) U.S. Cl.
CPC ..... *B65H 3/0816* (2013.01); *B65H 2405/115* (2013.01)

(58) Field of Classification Search
CPC ..... B65H 3/0816; B65H 3/0883; B65H 2405/115; B65H 1/04
See application file for complete search history.

(56) References Cited

U.S. PATENT DOCUMENTS 3,865,325 A * 2/1975 Newcomer, Jr. ..... B65H 75/00 242/160.3
4,921,237 A 5/1990 Nubson et al.
5,083,763 A 1/1992 Hartta
6,886,827 B2 * 5/2005 Dachtler ..... B65H 3/48 271/106
7,328,895 B2 * 2/2008 Dinatale ..... B65H 3/0816 271/106
7,748,698 B2 * 7/2010 Shelhart ..... B65H 3/48 271/97
9,895,869 B2 2/2018 Kitagawa
2015/0202654 A1 * 7/2015 Kitagawa ..... B65H 3/0816 427/207.1

OTHER PUBLICATIONS

Extended European search report from European Application No. 20163477.1, dated Sep. 29, 2020, 7 pages.

* cited by examiner

*Primary Examiner* — Howard J Sanders
(74) *Attorney, Agent, or Firm* — Leydig, Voit & Mayer, Ltd.

(57) ABSTRACT

The present invention relates to a cover member for a storing means, a respective storing means and a gripping system, comprising said storing means. Further, the present invention relates to a method for gripping and separating stacked flat elements. The cover member is adapted for being installed on a top side of a storing means for storing a stack of multiple flat elements 100 having a predefined size. The cover member 1 defines a first opening 13 having a rim portion 13*a*, 13*b*, wherein the first opening 13 is adapted to be associated with at least one gripping unit 30, so that the gripping unit 30 can access the storing means for gripping and removing a flat element 102 through the first opening 13, when the cover member 1 is installed on the top side of the storing means 10. The first opening is sized so that a gripped flat element 102 abuts the rim portion 13*a*, 13*b* when being removed through the first opening 13 from the storing means, so as to be bend and separated from an underlying flat element 104.

18 Claims, 4 Drawing Sheets

COVER MEMBER FOR A STORING MEANS FOR STACKED FLAT ELEMENTS

CROSS-REFERENCE TO RELATED APPLICATIONS

This application is a U.S. Nonprovisional Application filed under 35 U.S.C. § 111(a) which claims the benefit of European patent Application No. 20163477.1, filed Mar. 17, 2020. This application is hereby incorporated by reference in its entirety.

FIELD OF THE INVENTION

The present invention relates to a cover member for a storing means for stacked flat elements, a respective storing means and a gripping system, comprising said storing means. Further, the present invention relates to a method for gripping and separating stacked flat elements.

TECHNICAL BACKGROUND

Flat elements, such as sheets of paper or cardboard, fabrics, non-wovens, foils and/or other sheets, such as sheet metals and/or wood-based, metal-based and/or plastic based sheets are typically provided as stacks.

Before those stacked flat elements can be further processed, the individual elements must be separated from each other. For separating stacked flat elements vacuum grippers are known that grip the top element of a stack of stacked flat elements. For gripping a flat element, a vacuum gripper provides a negative pressure, and thus sucks the respective element. This allows to grip and hold very large loads, provided the prehension surface is smooth enough to ensure suction.

Known grippers, such as vacuum grippers, oftentimes grip not only a single flat element, i.e. a top element of a stack, but multiple elements. Gripping multiple elements is undesired, as the elements typically shall be further processed one by one. Thus, gripping multiple elements may lead in further processing devices to processing failures or to rejects parts. Thus, manual intervention is often required to separate gripped elements manually after automated gripping.

Gripping of multiple flat elements can be caused by an initial adhesion of the flat elements to each other. Furthermore, elements can adhere to each other because they are sucked together by the vacuum grippers. This is particularly the case, if the flat elements are permeable to air, such as non-woven or woven fabrics.

In order to be able to provide gripped and separated flat elements, known gripping devices typically include an autonomous separation device, leading to mechanically complex gripping devices and to increased cycle times, as a gripped element must be separated after gripping.

Thus, it is an object of the present invention to improve the gripping and the separation of stacked flat elements and to provide a device/system that allows for securely gripping and separating a top element of a stack of stacked flat elements from underlying elements.

SUMMARY OF THE INVENTION

The object is achieved, at least in part, by a cover member according to claim 1, a storing means according to claim 6, a gripping system according to claim 9 and a method for separating stacked flat elements according to claim 13.

In particular, the object is achieved by a cover member that is adapted for being installed on a top side of a storing means, wherein said storing means is adapted for storing a stack of multiple flat elements having a predefined size. The cover member defines a first opening having a rim portion, wherein the first opening is adapted to be associated with at least one gripping unit, so that the gripping unit can access the storing means for gripping and removing a flat element through the first opening, when the cover member is installed on the top side of the storing means. Further, the first opening is sized so that a gripped flat element abuts the rim portion when being removed through the first opening from the storing means, so as to be bend and separated from an underlying flat element.

The storing means, upon which the cover member can be installed may be any kind of storing place that is adapted to store and provide a stack of stacked flat elements. Particularly, the storing means may be provided as a pallet or storing box that at least partially encloses a stack stacked flat elements. Providing a storing box allows to transport and protect the stack of stacked flat elements from being damaged. The storing means may be interchangeable, so that after the last flat element is removed from the storing means, the empty storing means can be replaced by a filled storing means. Alternatively, or additionally, the storing means may be configured to be refillable.

The cover member may be installed on said storing means so that it is not lifted upon removing a gripped flat element through the first opening. For example, the cover member may be installed on said storing means by at least one of the following: a threaded member, a bolt member, a locking member, a bayonet joint member, a hook member, a latching member, or the like. The cover member may be installed on said storing means permanently or removable, wherein a removable installation preferably can be done tool free. Further, the cover member may be integrally formed with the storing means or at least parts thereof.

The separation of a gripped flat element from underlying flat elements of the stack of stacked flat elements is achieved by abutting the gripped flat element against the rim portion when removing the same through the first opening of the cover member from the storing means. The abutting leads to a bending of the gripped flat element. In case multiple flat elements are gripped, those elements are bend with different bending radii and thus, the gripped top flat element is separated from the underlying unintentionally gripped flat element(s). Thus, the gripped top flat element can be separately removed from the storing means, wherein the underlying flat elements remain stored in the storing means.

To ensure a sufficient bending for separation and prevent damaging of the flat elements, the rim portions of the first opening may be arranged in parallel and spaced from each other in a distance x. Further, the stacked flat elements may have a first dimension l in a direction substantially perpendicular to the rim portions, when being stored in the storing means, wherein the ratio of x:l may be in the range from 1:10 to 1:2, or in a range from 1:8 to 1:3, or in a range from 1:6 to 1:4. Further, the distance x of the rim portions of the first opening may be adjustable, so as to adapt the first opening to the dimensions of the stored flat elements.

The stacked flat elements may comprise at least one of the following: a paper, a cardboard, a fabric, a non-woven, a foil and a sheet. Further, the stacked flat elements may be wood-based, metal-based and/or plastic based elements. In particular, the stacked flat elements may be air permeable.

For example, the stacked flat elements may be Tyvek® based, wherein Tyvek® is a non-woven, based on high-density polyethylene fibers.

The cover member may further include at least two separation bars, wherein the separation bars define the first opening at least partially, and wherein the rim portion may be provided on the separation bars. Particularly, the separation bars may be arranged movable relative to each other, so that a distance x between the rim portions of the first opening can be adjusted. This allows to adapt the storing means/cover member to different kinds and sizes of stored stacked flat elements.

The first opening may be arranged in a center portion of the cover member so that the at least one associated gripping unit is adapted to grip the flat element centrally, when the cover member is installed on the top side of the storing means. A centered gripping of the flat element(s) leads to a uniform bending and thus facilitates the separation.

Further, the rim portion of the first opening may comprise a rounded edge that is adapted to abut the gripped flat element. The rounded edge may optionally be formed on a protector element that forms the rim portion of first opening at least partially. Providing rounded edges prevents the flat elements from being damaged during bending and removal. The protector element may be exchangeable so that the storing means can easily be adapted to different types of stacked flat elements.

The cover member may include second and/or third openings being associated with a second gripping unit, so that said second gripping unit can access the storing means through the second and/or third openings, when the cover member is installed on the top side of the storing means. Particularly, the cover member may include one second opening and one third opening and/or the cover member may include multiple second openings and/or multiple third openings. The second and/or third openings allow the second gripping unit to enter (at least partially) the storing means. Thus, first and second gripping unit can be installed in a desired gripping plane and can be moved together. In this case, the initial gripping may be executed by the first gripping unit, wherein the second gripping unit is inactive (i.e. initially, the second gripping unit does not grip the flat element). Subsequently, after the gripped flat element is separated and removed from the storing means, the second gripping unit may become active and grip the flat element in addition to the first gripping unit. Optionally, after the second gripping unit has become active, the first gipping unit can become inactive.

The object is further achieved by a storing means for storing a stack of multiple flat elements having a predefined size. The storing means is adapted for being accessible by a gripping unit and includes a cover member, according to any aspect as described above. Particularly, the cover member defines a first opening having a rim portion and is adapted to be associated with at least one gripping unit, so that the gripping unit can access the storing means for gripping and removing a flat element through the first opening. The first opening is sized so that a gripped flat element abuts the rim portion when being removed through the first opening from the storing means, so as to be bend and separated from an underlying flat element.

The storing means may be any kind of storing place that is adapted to store and provide a stack of stacked flat elements. Particularly, the storing means may be provided as a pallet or a storing box that at least partially encloses a stack stacked flat elements. Providing a storing box allows to transport and protect the stack of stacked flat elements from being damaged. The storing means may be interchangeable, so that after the last flat element is removed from the storing means, the empty storing means can be replaced by a filled storing means. Alternatively, or additionally, the storing means may be configured to be refillable. Further, the inner dimensions of the storing means may be adapted to the predefined size of the flat elements to be stored, so as to prevent the stack of stacked flat elements from getting out of place and/or from getting skewed. Still further, the inner dimensions of the storing means may be adaptable to the predefined size of the flat elements, e.g. by at least one insertable element and/or at least one relocatable element, such as a relocatable side wall.

The cover member may be installed on said storing means storing means permanently or removable, or the cover member may be integrally formed with the storing means or at least parts thereof.

The storing means may comprise a blower connection member, that is adapted to connect the storing means with a blower to provide a lateral air flow on the stack of multiple flat elements, so that a separating air flow is established at least between a top flat element and an underlying flat element of the stack of multiple flat elements.

The blower connection member may be any kind of connection member that allows to guide an air flow, established by a blower, to the storing means. The blower may be a separate device or may be integrated into the storing means. Particularly, the blower, when connected to the storing means, may be configured to cause the stacked flat elements to move within the storing means, so as to reduce or even prevent an initial adhering between adjacent stacked flat elements. The initial adhering can be further reduced or even limited by establishing a separating air between adjacent flat elements.

Further, the blower may be configured to establish a separating air flow between a gripped top flat element and an underlying unintentionally gripped flat element. Said separating air flow can enter a gap that is formed between the gripped top flat element and the underlying unintentionally gripped flat element(s) due to the different bending radii of the gripped flat elements. The separating air then also to securely separate the gripped top flat element from the underlying flat element(s).

The storing means may further comprise a sidewall including at least one groove that is in communication with the blower connection member. Optionally, the at least one groove may extend in a stack direction z of the stack of multiple flat elements.

The sidewall including at least one groove may be part of the cover member or may be formed as a sidewall that is independent of the cover member. The at least one groove may be designed to guide the separating air flow towards the stack of stacked flat elements. Particularly, the at least one groove may be designed so as to provide a separating air flow that extends over the entire height of the stack of stacked flat elements so as to allow to establish a separating air flow between adjacent stacked flat elements independently of the fill level of the storing means.

Particularly, multiple grooves may be provided, each in communication with the blower connection member. Those multiple grooves may be arranged parallel to each other, so as to establish a separating air flow over the width dimension of the stack of stacked flat elements. The at least one groove may be provided in a side wall that is parallel to the rim portions of first opening. Alternatively, or additionally, the least one groove may be provided in a side wall that is perpendicular to the rim portions of first opening. Further, the grooves may be distributed over at least two side walls of the storing means, wherein these side walls may be in contact to each other or may be facing each other. Further, the at least one groove may be covered by an air permeable cover, such as a perforated plate, to prevent the grooves from being clogged.

The object is further achieved by a gripping system for stacked flat elements, wherein the gripping system comprises a storing means as described above, which in turn comprises a cover member. Further, the gripping system comprises at least one gripping unit, that is associated with the first opening of the cover member of the storing means. The at least one gripping unit is adapted to grip a flat element from a stored stack of multiple flat elements and to remove the gripped flat element through the first opening, so that the gripped flat element abuts the rim portion of the first opening when being removed through the first opening from the storing means, so as to be bend and separated from an underlying flat element.

The separation of a gripped flat element from underlying flat elements of the stack of stacked flat elements is achieved by abutting the gripped flat element against the rim portion when removing the same through the first opening of the cover member from the storing means. The abutting leads to a bending of the gripped flat element. In case multiple flat elements are gripped, those elements are bend with different bending radii and thus, the gripped top flat element is separated from the underlying unintentionally gripped flat element(s). Thus, the gripped top flat element can be separately removed from the storing means, wherein the underlying flat elements remain stored in the storing means.

The gripping unit may comprise at least one gripping device being a vacuum gripper. Optionally, the gripping unit may comprise multiple vacuum grippers, being arranged in a row. A vacuum gripper allows to securely grip a stacked flat element securely without damaging the same. With providing multiple vacuum grippers, the gripping can be improved. A row of vacuum grippers allows to securely grip a stacked flat element, while enabling a bending of the gripped flat element, when removing the same through the first opening of the storing means. Thus, flat elements with large dimensions can be securely handled.

Further, the at least one gripping unit may be a first gripping unit. Additionally, the gripping system may comprise a second gripping unit that is adapted to additionally grip a gripped flat element after being removed through the first opening. The second gripping unit is optionally adapted to hold the gripped flat element in a gripping plane, wherein the gripping plane may be substantially horizontal.

Said second gripping unit allows to grip and hold the removed flat element even more securely. Holding the flat element in a gripping plane, i.e. substantially flat, prevents the flat element from being damaged due to a permanent bending and also facilitates the handover to a further processing unit. Thus, the separation device can be easily integrated in an automation line. The second gripping unit may be inactive during the initial gripping of the top flat element by the first gripping unit. Alternatively, the second gripping unit may be installed outside the storing means so that the second gripping occurs only after the gripped flat element is removed from the storing means.

Further, the first gripping unit and the second gripping unit may be adapted to be movable in the stack direction z of the stack of multiple flat elements. This facilitates the gripping of the stacked flat elements. Further, the first gripping unit may be movable independently of the second gripping unit in the stack direction z of the stack of multiple flat elements. This allows to install the second gripping unit outside the storing means, wherein only the first gripping unit enters the storing means for initially gripping a flat element.

The second gripping unit may comprise at least one gripping device being a vacuum gripper. Optionally, the second gripping unit comprises multiple vacuum grippers, being arranged in rows, further optionally sandwiching the first gripping unit. A vacuum gripper allows to securely grip a removed flat element without damaging the same. With providing multiple vacuum grippers, the gripping can be improved. A row of vacuum grippers allows to securely grip a removed flat element and to hold the same in a gripping plane. This is in particular true, if the second gripping unit comprises rows of vacuum grippers that sandwich the first gripping unit. The vacuum grippers of the second gripping unit may be arranged in two parallel rows. Further rows may be provided to allow the handling of flat elements with large dimensions. Vacuum grippers can be easily controlled to be active or inactive, by providing a sufficient negative pressure for gripping (active state) or by providing an insufficient negative pressure or no negative pressure (inactive state).

Further, the second gripping unit may be adapted to be operated in a blower mode. In this case, the second gripping unit may provide a positive pressure, i.e. an air flow in direction of the flat element to be gripped, during the initial gripping. This may lead to an additional bending of the flat element and thus, improves the separation.

The object is also achieved by a method for separating stacked flat elements, wherein the method comprising the steps of:

providing a gripping system as described above;

storing a stack of multiple flat elements in a storing means of the gripping system;

gripping a flat element through the first opening, using the first gripping unit of the gripping system, and removing the gripped flat element through the first opening, thereby bending the gripped flat element due to abutment with the rim portion of the first opening, so as to separate the gripped flat element from an underlying flat element.

The method may further comprise the step of laterally blowing, using the blower, on the stack of multiple flat elements, and establishing a separating air flow at least between a top flat element and an underlying flat element of the stack of multiple flat elements.

Still further, the method may comprise the step of gripping the flat element after being removed through the first opening using a second gripping unit, wherein the second gripping unit is optionally set to an inactive state, while the first gripping unit grips and removes a flat element through the first opening.

The method may further comprise the step of moving the gripped flat element, using the first and/or second gripping unit to an installation area or to a handover area.

With this method, all advantages described above with respect to the separation device and/or the storing means can be achieved.

BRIEF DESCRIPTION OF THE FIGURES

In the following, the accompanying figures which show embodiments of the present invention are briefly described.

DETAILED DESCRIPTION OF THE INVENTION

Figure 1:
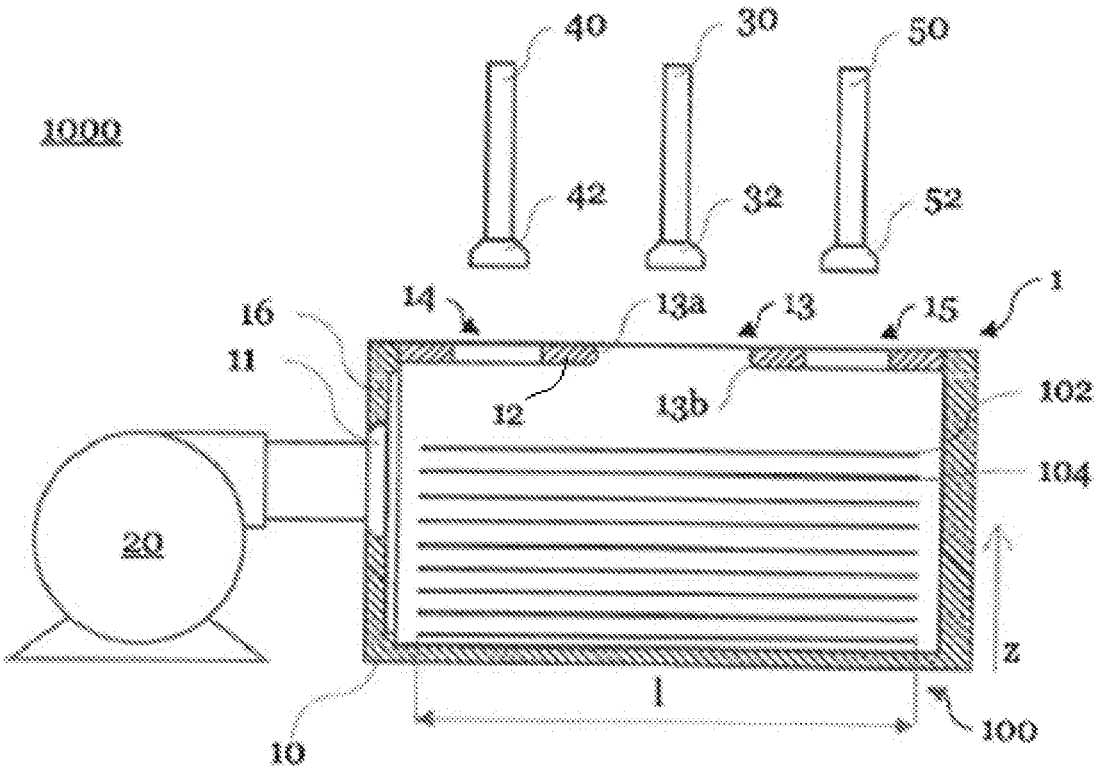
FIG. 1 shows a schematic illustration of a gripping system, in an initial state.

FIGS. 1 to 6 show a schematic illustration of a gripping system 1 in different operation states. The gripping system 1000 comprises a storing means 10 for storing a stack 100 of stacked flat elements 102, 104 and optionally a blower 20. Further, the gripping system 1000 comprises a first gripping unit 30 and a second gripping unit 40, 50. Each gripping unit 30, 40, 50 may comprise (multiple) gripping devices 32, 42, 52 that may be provided as vacuum grippers. The first gripping unit 30 is adapted to initially grip a flat element 102 from the stored stack 100 of multiple flat elements, stored in the storing means 10.

The storing means 10 comprises a cover member 1 that is installed on a top side of the storing means 10. The cover member 1 defines a first opening 13 having a rim portion 13*a*, 13*b*, formed on a protector element 12, wherein the first opening 13 is associated with at least one gripping unit 30. The gripping unit 30 can access the storing means 10 for gripping and removing a flat element 102 through the first opening 13. Further, the first opening 13 is sized so that a gripped flat element 102 abuts the rim portion when being removed through the first opening 13 from the storing means 10, so as to be bend and separated from an underlying flat element 104, as will be described in greater detail with respect to FIGS. 3 and 4.

The second gripping unit 40, 50 is adapted to grip a gripped flat element 102 after being removed through a first opening 13 of the storing means 10. The second gripping unit 40, 50 is optionally adapted to hold the gripped flat element 102 in a gripping plane that may be substantially horizontal (cf. FIG. 6).

The blower 20 is adapted to blow laterally on the stack of multiple flat elements 100, so that a separating air flow is established at least between a top flat element 102 and an underlying flat element 104 of the stack of multiple flat elements 100. The blower 20 is connected with the storing means by means of a blower connection member 11. Further, the storing means 10 and/or the cover member 1 may comprise a sidewall including at least one groove 16. Said groove 16 is in communication with the blower connection member 11 and therefor with the blower 20. In the embodiment shown in FIGS. 1 to 6, the at least one groove 16 extends in a stack direction z of the stack 100 of multiple flat elements.

In FIG. 1, the gripping system 1000 is shown in an initial state. The first gripping unit 30 and the second gripping unit 40, 50 are positioned outside the storing means 10, which stores a stack 100 of stacked flat elements 102, 104. The first gripping unit 30 and the second gripping unit 40, 50 are inactive.

Figure 2:
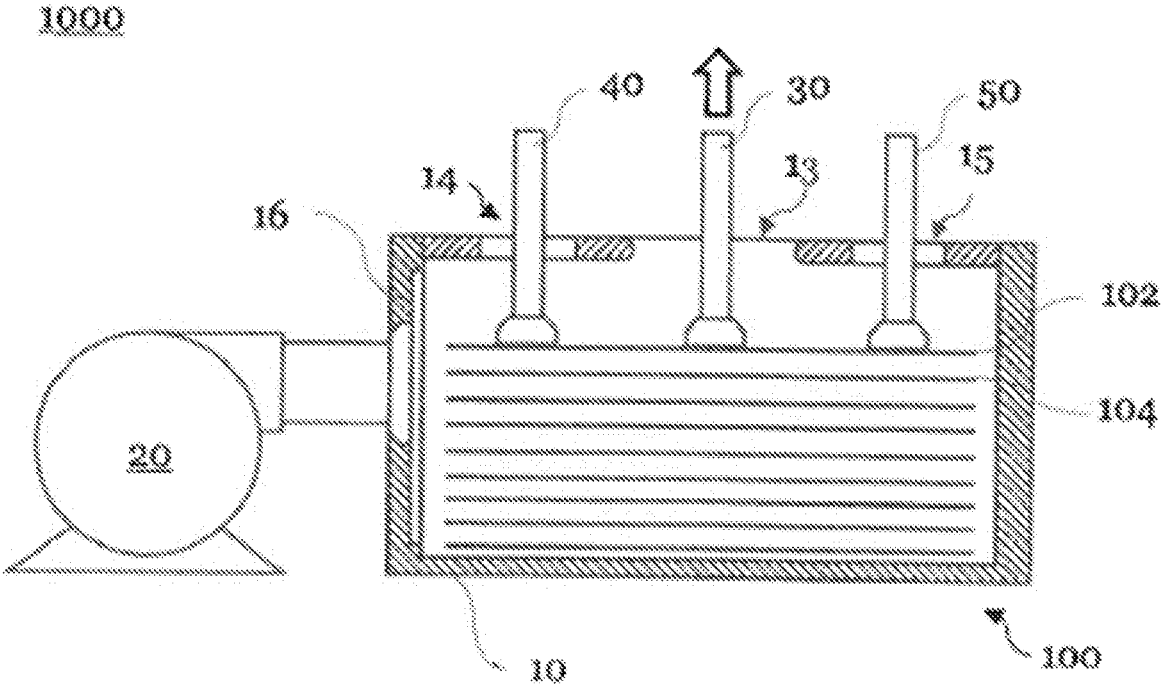
FIG. 2 shows a schematic illustration of a gripping system, during gripping.

In FIG. 2, the gripping system 1000 is shown during initial gripping. The first gripping unit 30 has entered the storing means 10 via the associated first opening 13 of the cover member 1. Likewise, the second gripping unit 40, 50 may enter the storing means 10 via associated second and third openings 14, 15 of the cover member 1. During the initial gripping, the first gripping unit 30 is active and grips the top stacked flat element 102 centrally. The second gripping unit 40, 50 may either be inactive (as shown) or may be operated in a blower mode, so as to provide an air flow that is directed onto the surface of the top stacked flat element 102 (not shown). Alternatively, the second gripping unit 40, 50 may not enter the storing means 10, but may be installed outside the storing means 10 (not shown). The blower 20 may move the stacked flat elements within the storing means 10 and/or may cause a separating air flow between adjacent stacked flat elements 102, 104.

Figure 3:
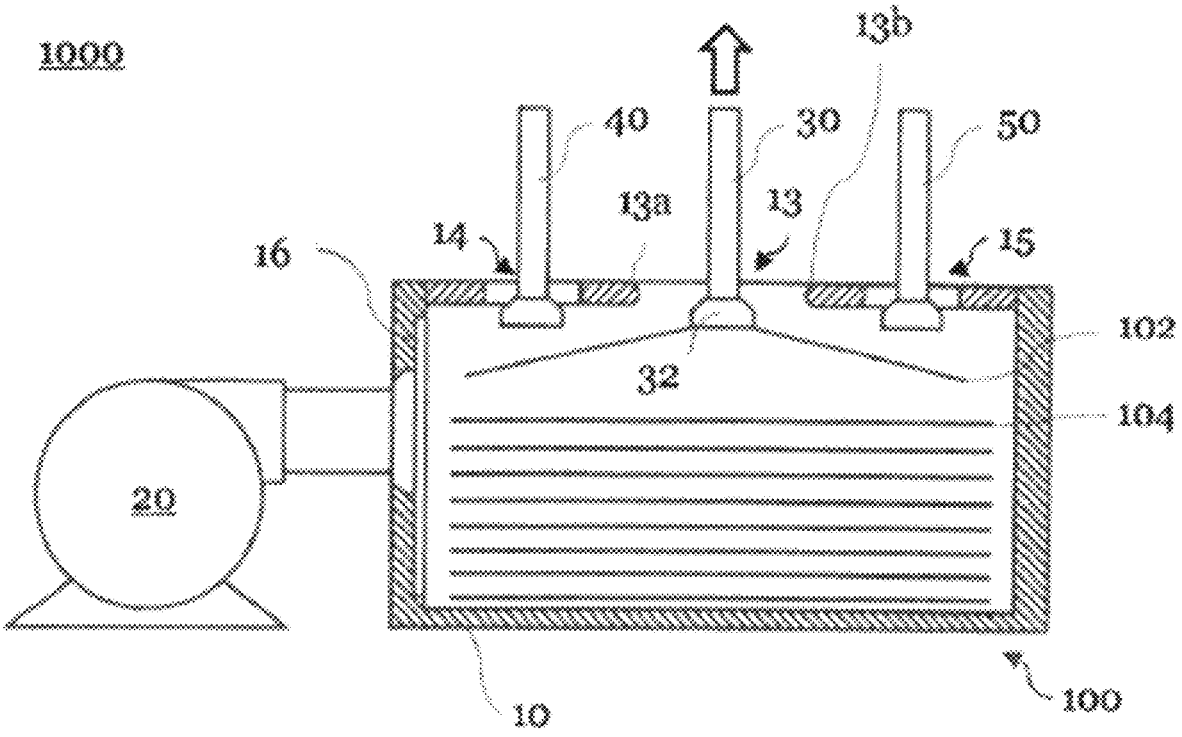
FIG. 3 shows a schematic illustration of a gripping system, with a gripped flat element.

In FIG. 3, the gripping system 1000 is shown with an initially gripped flat element 102, wherein the flat element 102 is gripped by a gripping device 32, such as a vacuum gripper, of the first gripping unit 30. In this state, the first gripping unit 30 is partially retracted from the storing means 10. As the gripped flat element 102 is gripped only by the first gripping unit 30, an initial bending of the gripped flat element 102 may occur.

Figure 4:
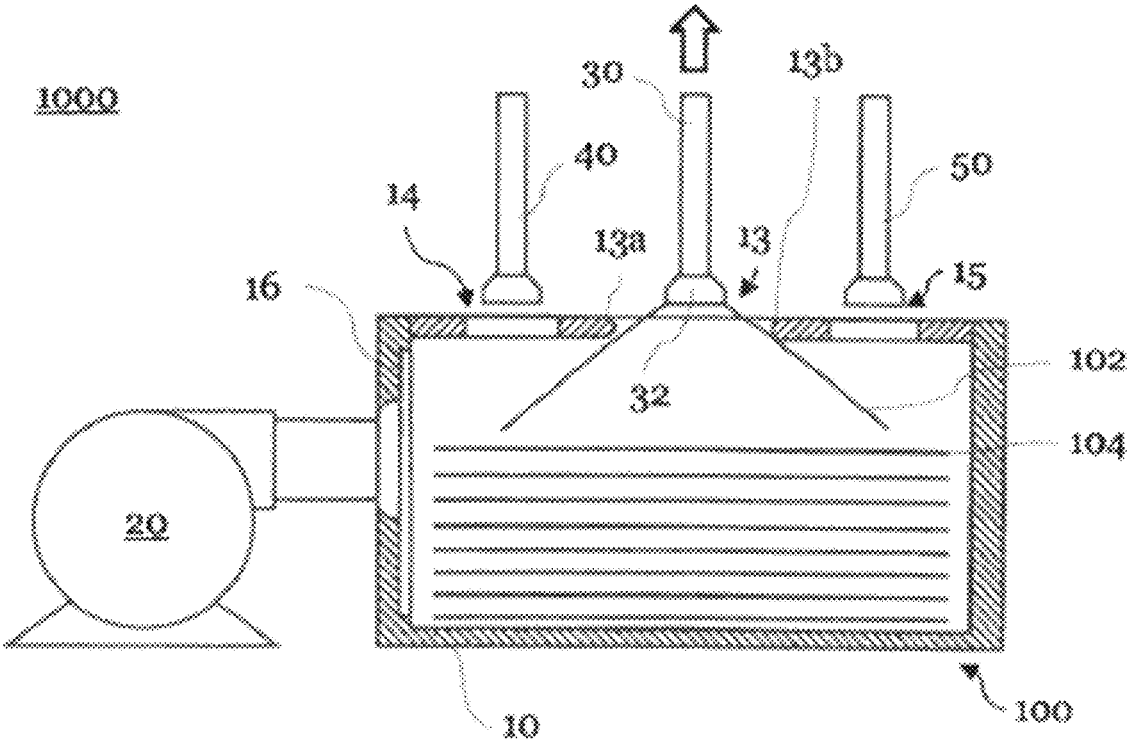
FIG. 4 shows a schematic illustration of a gripping system, with a gripped bend flat element.

This initial bending is increased in the state shown in FIG. 4. Here, the first gripping unit 30 is further retracted from the storing means 10. The first opening 13 of the cover member 1 is sized so that the gripped flat element 102 abuts the rim portion 13*a*, 13*b* when being removed through the first opening 13 from the storing means 10. Said abutting increases the bending and leads to a separation of the gripped flat element 102 from the underlying flat element 104.

In case the first gripping unit 30 unintentionally gripped initially multiple flat elements (not shown), those elements are bend with different bending radii, leading to a gap between the gripped multiple flat elements. A separating air flow can enter said gap, and thus, the gripped top flat element 102 is separated from the underlying unintentionally gripped flat element(s) 104.

Figure 5:
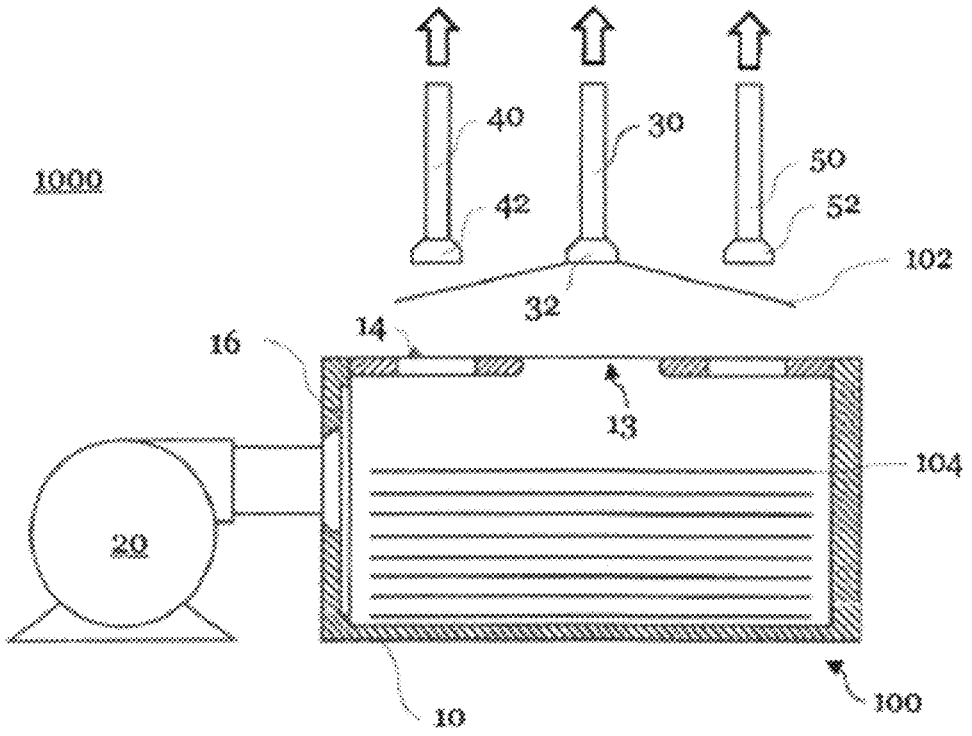
FIG. 5 shows a schematic illustration of a gripping system, with a removed gripped flat element.
Figure 6:
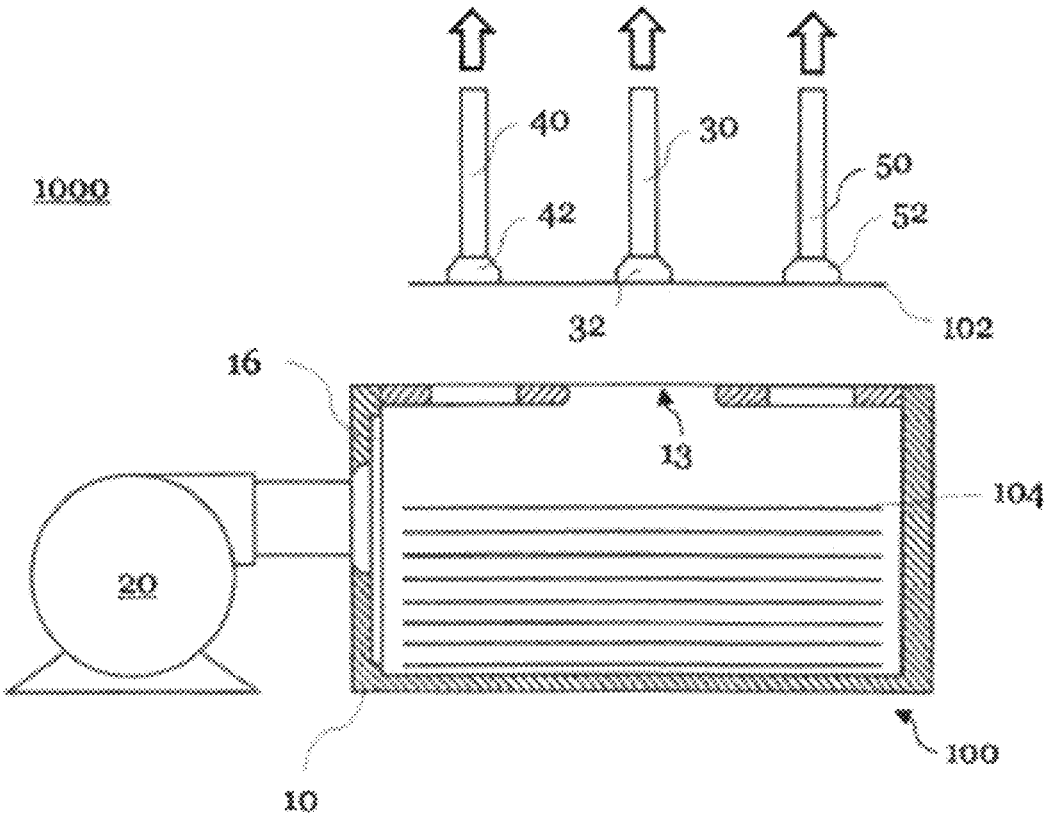
FIG. 6 shows a schematic illustration of a gripping system, with a gripped flat element, being gripped by the first and the second gripping unit.

In FIG. 5, the gripping system 1000 is shown with an initially gripped flat element 102, wherein the gripped flat element 102 is separated and removed from the storing means 10. In this state, the second gripping unit 40, 50 may become active (switched to gripping/suction mode). Thereby, the initially gripped flat element 102 is additionally gripped by the second gripping unit 40, 50, as shown in FIG. 6. Here, the gripped flat element 102 is gripped and held in a gripping plane and can be provided to a further processing unit.

Figure 7:
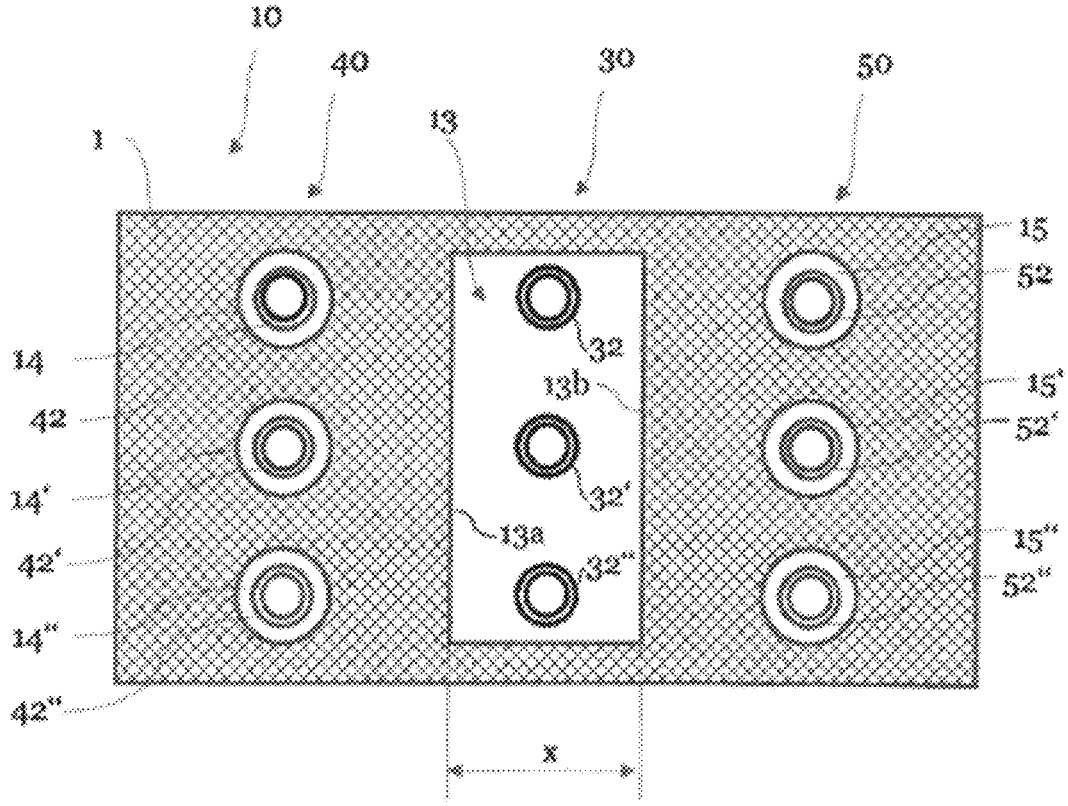
FIG. 7 shows a schematic illustration of a top view of a gripping system.

FIG. 7 shows a schematic illustration of a top view of a gripping system 1000, particularly of a storing means 10. In this embodiment, the storing means 10 comprises one first opening 13 with rim portions 13*a*, 13*b*. The first opening is sized so that a gripped flat element abuts the rim portions 13*a*, 13*b* when being removed through the first opening 13 from the storing means 10. The rim portions 13*a*, 13*b* of the first opening 13 may be arranged in parallel and spaced from each other in a distance x, wherein the distance x of the rim portions 13*a*, 13*b* of the first opening 13 may be adjustable, so as to adapt the first opening 13 to the dimensions of the stored flat elements. Particularly, the rim portions 13*a*, 13*b* of the first opening 13 can be provided on respective separation bars (not shown) that form the first opening at least partially.

Said first opening 13 is associated with the first gripping unit 30, which comprises multiple gripping devices 32, 32', 32", being vacuum grippers. Said vacuum grippers are arranged in a row.

Further, the storing means 10 includes multiple second openings 14, 14' and 14" and multiple third openings 15, 15' and 15". The second openings 14, 14' and 14" are associated with the second gripping unit, particularly with multiple gripping devices 42, 42', 42", being vacuum grippers, of the second gripping unit 40. The gripping devices 42, 42', 42" are arranged in a first row of gripping devices of the second gripping unit 40. Further, the third openings 15, 15' and 15" are associated with the second gripping unit 50, particularly with multiple gripping devices 52, 52', 52", being vacuum grippers, of the second gripping unit. The gripping devices 52, 52', 52" are arranged in a second row of gripping devices of the second gripping unit 50. The first and second row of gripping devices of the second gripping unit 40, 50 sandwich the row of gripping devices 32, 32', 32" of the first gripping unit 30.

The design of the first, second and third openings 13, 14 and 15 is not limited to the design shown in FIG. 7. Alternatively, only one second and third opening 14 and 15 may be provided, wherein first, second and third openings 13, 14 and 15 may be separated from each other by separation bars of the storing means 10.

Figure 8:
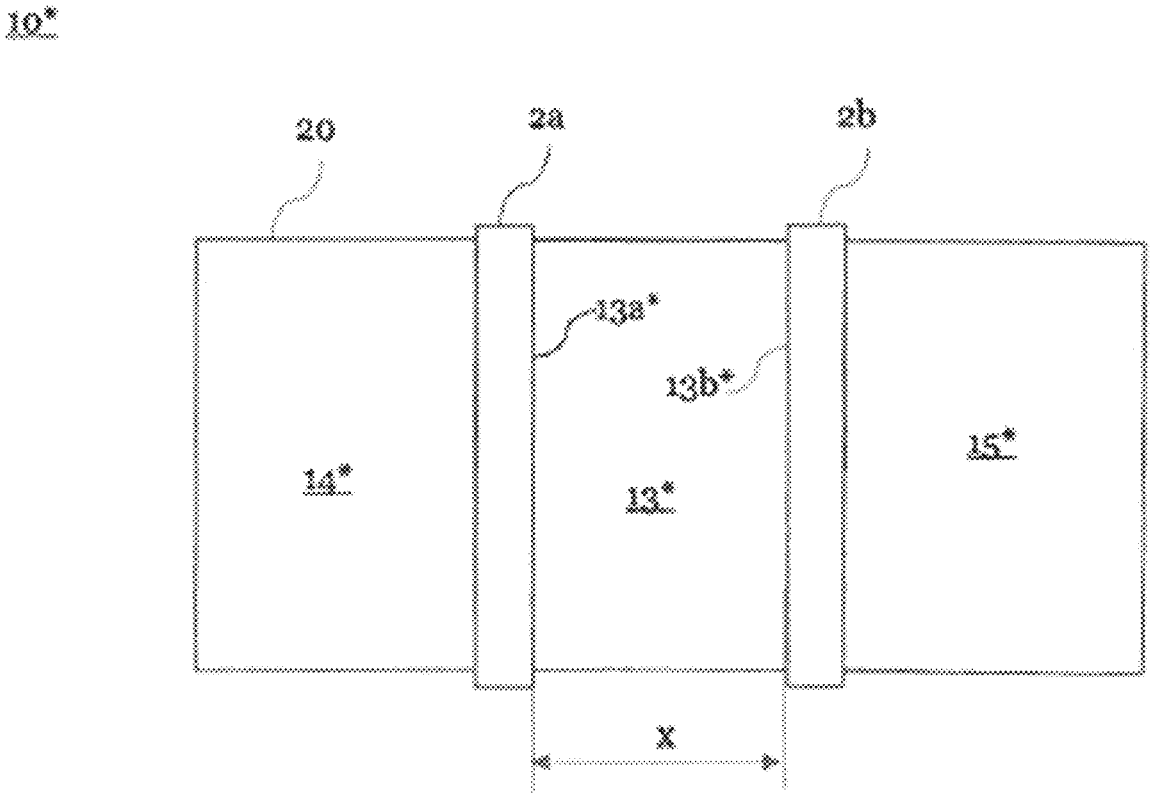
FIG. 8 shows a schematic illustration of a top view of a storing means.

FIG. 8 shows a schematic illustration of a top view of a storing means 10*. In this embodiment, the storing means 10* comprises one first opening 13* with rim portions 13*a, 13*b. The first opening 13* is sized so that a gripped flat element abuts the rim portions 13*a, 13*b when being removed through the first opening 13* from the storing means 10*. The rim portions 13*a, 13*b of the first opening 13* are arranged in parallel and spaced from each other in a distance x, wherein the distance x of the rim portions 13*a, 13*b of the first opening 13* may be adjustable, so as to adapt the first opening 13* to the dimensions of the stored flat elements. Particularly, the rim portions 13*a, 13*b of the first opening 13* are provided on separation bars 2*a*, 2*b* that form the first opening 13* at least partially. In the embodiment shown, the cover member is substantial formed by the separation bars 2*a*, 2*b*, which are installed on top of the storing means 10*. The separation bars 2*a*, 2*b* divide a top side of the storing means 10* in to a first opening 13*, a second opening 14* and a third opening 15*.

Having now fully described the present invention in some detail by way of illustration and examples for purposes of clarity of understanding, it will be obvious to one of ordinary skill in the art that the same can be performed by modifying or changing the invention within a wide and equivalent range of conditions, formulations and other parameters without affecting the scope of the invention or any specific embodiment thereof, and that such modifications or changes are intended to be encompassed within the scope of the appended claims.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. Any recitation herein of the term "comprising", particularly in a description of components of a composition or in a description of elements of a device, is understood to encompass those compositions and methods consisting essentially of and consisting of the recited components or elements.

One of ordinary skill in the art will appreciate that starting materials, device elements, analytical methods, mixtures and combinations of components other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. The invention illustratively described herein suitably may be practiced in the absence of any element or elements, limitation or limitations which is not specifically disclosed herein. Headings are used herein for convenience only.

All publications referred to herein are incorporated herein to the extent not inconsistent herewith. Some references provided herein are incorporated by reference to provide details of additional uses of the invention. All patents and publications mentioned in the specification are indicative of the levels of skill of those skilled in the art to which the invention pertains. References cited herein are incorporated by reference herein in their entirety to indicate the state of the art as of their filing date and it is intended that this information can be employed herein, if needed, to exclude specific embodiments that are in the prior art.

LIST OF REFERENCE SIGNS

1 cover member
2*a*, 2*b* separation bar
10 storing means
11 blower connection member
12 protector element
13 first opening
13*a* rim portion
13*b* rim portion
14 second opening
15 third opening
16 groove
20 blower
30 first gripping unit
32 gripping device
40, 50 second gripping unit
42, 52 gripping device
100 stack of flat elements
102 flat element
104 flat element
1000 gripping system
z stack direction
x distance between rim portions
l first dimension of flat element

The invention claimed is:

1. A cover member adapted for being installed on a top side of a storing means for storing a stack of multiple flat elements having a predefined size, the cover member comprising a first opening having a rim portion, wherein the first opening is adapted to be associated with at least one gripping unit, so that the gripping unit is able to access the storing means for gripping and removing a flat element through the first opening, when the cover member is installed on the top side of the storing means, wherein the first opening is sized so that a gripped flat element abuts the rim portion when being removed through the first opening from the storing means, so as to bend and be separated from an underlying flat element, wherein the rim portion comprises a rounded edge that is adapted to abut the gripped flat element, wherein the rounded edge is optionally formed on a protector element that forms the rim portion of the first opening at least partially, and wherein the cover member further comprises second and/or third openings adapted to be associated with a second gripping unit, so that the second gripping unit can access the storing means through the second and/or third openings, when the cover member is installed on the top side of the storing means.

2. The cover member according to claim 1, comprising at least two separation bars, wherein the separation bars define the first opening at least partially, and wherein the rim portion is provided on the separation bars.

3. The cover member according to claim 1, wherein the first opening is arranged in a center portion of the cover member so that the at least one associated gripping unit is adapted to grip the flat element centrally, when the cover member is installed on the top side of the storing means.

4. A storing means for storing a stack of multiple flat elements having a predefined size, the storing means being further adapted for being accessible by a gripping unit, wherein the storing means comprises a cover member according to claim 1, defining a first opening having a rim portion, wherein the first opening is adapted to be associated with at least one gripping unit, so that the gripping unit is able to access the storing means for gripping and removing a flat element through the first opening, wherein the first opening is sized so that a gripped flat element abuts the rim portion, when being removed through the first opening from the storing means, so as to bend and be separated from an underlying flat element.

5. The storing means according to claim 4, further comprising a blower connection member, that is adapted to connect the storing means with a blower to provide a lateral air flow on the stack of multiple flat elements, so that a separating air flow is established at least between a top flat element and an underlying flat element of the stack of multiple flat elements.

6. The storing means according to claim 5, wherein the storing means comprises a sidewall including at least one groove that is in communication with the blower connection member.

7. The storing means according to claim 6, wherein the at least one groove extends in a stack direction (z) of the stack of multiple flat elements.

8. A gripping system for stacked flat elements, wherein the gripping system comprises:

a storing means according to claim 4, and at least one gripping unit that is associated with the first opening of the cover member of the storing means, wherein the at least one gripping unit is adapted to grip a flat element from a stored stack of multiple flat elements and to remove the gripped flat element through the first opening, so that the gripped flat element abuts the rim portion of the first opening when being removed through the first opening from the storing means, so as to be bend and separated from an underlying flat element.

9. The gripping system according to claim 8, wherein the gripping unit comprises at least one gripping device being a vacuum gripper.

10. The gripping system according to claim 9, wherein the gripping unit comprises multiple vacuum grippers being arranged in a row.

11. The gripping system according to claim 8, wherein the at least one gripping unit is a first gripping unit, and wherein the gripping system further comprises a second gripping unit that is adapted to grip a gripped flat element after being removed through the first opening.

12. The gripping system according to claim 11, wherein the second gripping unit is adapted to hold the gripped flat element in a gripping plane, wherein the gripping plane may be substantially horizontal.

13. The gripping system according to claim 11, wherein the first gripping unit and the second gripping unit are able to be moved in the stack direction (z) of the stack of multiple flat elements.

14. The gripping system according to claim 13, wherein the first gripping unit is able to be moved independently of the second gripping unit in the stack direction (z) of the stack of multiple flat elements.

15. A method for gripping and separating stacked flat elements, the method comprising the steps of:

providing a gripping system according to claim 8;

storing a stack of multiple flat elements in a storing means of the gripping system;

gripping a flat element through the first opening, using the first gripping unit;

removing the gripped flat element through the first opening, thereby bending the gripped flat element due to abutment with the rim portion of the first opening, so as to separate the gripped flat element from an underlying flat element.

16. The method according to claim 15, further comprising laterally blowing, using a blower, on the stack of multiple flat elements, and establishing a separating air flow at least between a top flat element and an underlying flat element of the stack of multiple flat elements.

17. The method according to claim 15, further comprising gripping the flat element after being removed through the first opening using the second gripping unit.

18. The method according to claim 17, wherein the second gripping unit is set to an inactive state, while the first gripping unit grips and removes a flat element through the first opening.

* * * * *